United States Patent [19]

Lawver et al.

[11] 4,189,103

[45] Feb. 19, 1980

[54] METHOD OF BENEFICIATING PHOSPHATE ORES

[75] Inventors: James E. Lawver; Robert E. Snow, both of Lakeland; Walter O. McClintock, Bartow, all of Fla.

[73] Assignee: International Minerals & Chemical Corporation, Northbrook, Ill.

[21] Appl. No.: 885,156

[22] Filed: Mar. 10, 1978

[51] Int. Cl.[2] ..... B02C 23/18

[52] U.S. Cl. ..... 241/20; 209/12; 209/166

[58] Field of Search ..... 209/12, 166, 167, 172, 209/3; 241/20, 24

[56] References Cited

U.S. PATENT DOCUMENTS

| | | | |
|---|---|---|---|
| 2,158,220 | 5/1939 | Crago | 209/167 |
| 2,384,825 | 9/1945 | Ellis | 209/166 |
| 2,385,079 | 9/1945 | Hedley | 209/1725 |
| 2,526,519 | 10/1950 | Vogel-Jorgensen | 209/172.5 X |
| 2,599,530 | 6/1952 | Hodges | 209/166 |
| 2,610,738 | 9/1952 | Cuthbertson | 209/107 |
| 2,668,617 | 2/1954 | Houston | 209/12 X |
| 2,676,705 | 4/1954 | Duke | 209/160 |
| 2,763,371 | 9/1956 | LeBaron | 209/12 |
| 2,914,173 | 11/1959 | LeBaron | 209/166 |
| 3,259,242 | 7/1966 | Snow | 209/166 |
| 3,348,675 | 10/1967 | Tueter | 209/172 X |
| 3,388,793 | 6/1968 | Dibble | 209/12 X |
| 3,454,159 | 7/1969 | Mollinsworth | 209/12 X |
| 3,462,017 | 8/1909 | Bushell | 209/166 |
| 3,534,854 | 10/1970 | Viospi | 209/166 |
| 3,750,963 | 8/1973 | Dancy | 209/172 |

FOREIGN PATENT DOCUMENTS

| | | | |
|---|---|---|---|
| 653588 | 12/1962 | Canada | 209/166 |

*Primary Examiner*—Robert Halper

*Attorney, Agent, or Firm*—Schuyler, Birch, McKie & Beckett

[57] ABSTRACT

A method is disclosed for beneficiating a phosphate ore matrix containing apatite, siliceous gangue, and an alkaline earth metal carbonate mineral impuritywhich includes the steps of washing and sizing the ore, subjecting it to a gravity separation, a conventional "double float" flotation, and a phosphate-carbonate flotation separation to provide a phosphate ore concentrate having a high BPL content and a relatively low concentration of alkaline earth metal carbonate mineral impurity.

21 Claims, 1 Drawing Figure

PHOSPHATE PROCESSING FLOWSHEET

METHOD OF BENEFICIATING PHOSPHATE ORES

BACKGROUND OF THE INVENTION

This invention relates to a method for the beneficiation of mineral ores. More particularly, the invention relates to the beneficiation of phosphate ores containing alkaline earth metal carbonate mineral impurities.

Apatite is a common mineral and appears in small amounts in practically all igneous rocks (the term apatite as used herein is intended to include the mineral known as carbonate fluorapatite). Concentrations rich enough to justify mining are found in many localities. The mineral apatite is a phosphate of lime containing varying amounts of chlorine, fluorine, carbonate and hydroxyl. The phosphorus pentoxide content of various apatites ranges from 32 to 42 percent. The fluorine content has ranged as high as 3.8 percent, but generally is about 3.3 percent in fluorapatite.

The term "bone phosphate of lime", commonly abbreviated to BPL, is generally used to express the phosphate content of fertilizers. It is the equivalent of $Ca_3(PO_4)_2$.

In the analysis of phosphatic materials, the chemist generally reports the phosphorus content in terms of phosphorus pentoxide ($P_2O_5$).

For the major uses of apatite, the mineral is preferably in concentrated form. The phosphate industry requires, for the production of fertilizers, superphosphate, triple superhosphate and phosphoric acid, a phosphatic material of relatively high BPL content and imposes price pentalities where impurities are present in excess of certain maximum fixed percentages.

In order to be attractive on a commercial scale, a process for beneficiating a phosphate ore should produce a phosphate concentrate which is substantially free of gangue minerals. Many methods have been devised to beneficiate phosphate ores. Froth flotation beneficiation of phosphate minerals is commercially practiced on phosphate ores in which silicate minerals are the predominant gangue.

Such beneficiation generally comprises comminuting and classifying into various particle sizes. Coarser fractions may be suitable for direct sale or may be further beneficiated by sizing and skin flotation techniques. Extremely fine material, e.g. −325 mesh, which primarily contains clay slimes, is usually discarded. The intermediate fraction having a particle size range of −20 ±325 mesh poses the greatest beneficiation problems.

The "Crago" or "double float" froth flotation processes, as described by A. Crago in U.S. Pat. No. 2,293,640, Aug. 18, 1942, is commercially used for beneficiating such fractions of phosphate ores in which siliceous minerals are the predominant gangue. That process consists of conditioning the material with fatty acid reagents, flotation of the phosphate mineral, deoiling with sulfuric acid to remove the reagents, and refloating with amine reagents to remove the siliceous gangue which either floated or was trapped in the rougher fatty acid flotation.

Some phosphate ores contain carbonate gangue materials in addition to siliceous minerals. Alkaline earth metal carbonate minerals are common impurities in certain ore deposits. Examples of these deposits are the south Florida deposits and the western phosphates found in Idaho, Montana, Utah and Wyoming. Such mineral impurities include calcite ($CaCO_3$), dolomite (Ca,MgCO3), sea shells, aragonite, dolomitic limestone, and other less common minerals. The "double float" process has generally been ineffective for beneficiating such ores, because the flotation characteristics of the carbonate minerals are very similar to those of apatite.

Snow, R. E., U.S. Pat. No. 3,259,242, July 5, 1966, teaches the beneficiation of calcitic-apatite ores in which the apatite is in the crystalline form. The method has not, however, been found entirely satisfactory for sedimentary deposits of ores containing oolitic or non-crystalline apatite or for dolomitic-apatite ores.

In copending application Ser. No. 788,070 filed Apr. 18, 1977, Snow teaches a flotation method for beneficiating a finely divided phosphate ore concentrate which is substantially free of siliceous gangue. Such method is very useful for beneficiating sedimentary phosphate ore concentrates. The present invention teaches the entire upgrading of a mineral ore matrix as mined from the earth. In addition to phosphate values, such a matrix typically contains clay slimes, siliceous gangue and alkaline earth metal carbonate mineral impurities. The matrix comprises particle sizes ranging from large rocks to very fine slimes. Heretofore, no satisfactory method has been discovered for recovering phosphate values in good yield and satisfactory purity from such a matrix.

SUMMARY OF THE INVENTION

In accordance with the invention, there is disclosed a method for beneficiating a phosphate ore matrix containing apatite, siliceous gangue, and an alkaline earth metal carbonate mineral impurity, comprising the steps of (a) washing and sizing the ore matrix to substantially deslime the matrix and to remove particles larger than from about 2 mesh to about 5 mesh, thereby forming a deslimed ore matrix;

(b) splitting the deslimed ore matrix at about 12 to about 20 mesh to form a pebble fraction having a particle size greater than about 12 to about 20 mesh and a middle ore fraction having a particle size less than about 12 to about 20 mesh;

(c) subjecting the pebble fraction to a gravity separation wherein a portion of the less dense alkaline earth metal carbonate mineral impurity is separated from the apatite, thereby producing a low-carbonate fraction;

(d) splitting the middle ore fraction at about 24 mesh to about 32 mesh to form a coarse fraction having a particle size greater than about 24 mesh to about 32 mesh and a fine fraction having a particle size smaller than about 24 mesh to about 32 mesh;

(e) combining the coarse fraction with the pebble fraction to enter the gravity separation of step (c);

(f) comminuting, sizing and desliming the low carbonate fraction to a deslimed particle size of less than about 24 to about 32 mesh, thereby forming a floatation feed;

(g) subjecting the flotation feed to a "double float" flotation, thereby forming a low-silica intermediate flotation concentrate; and (h) subjecting the low silica intermediate flotation concentrate to a flotation to remove alkaline earth metal carbonate mineral impurity therefrom and to form a phosphate concentrate.

DETAILED DESCRIPTION OF THE INVENTION

Figure 1:
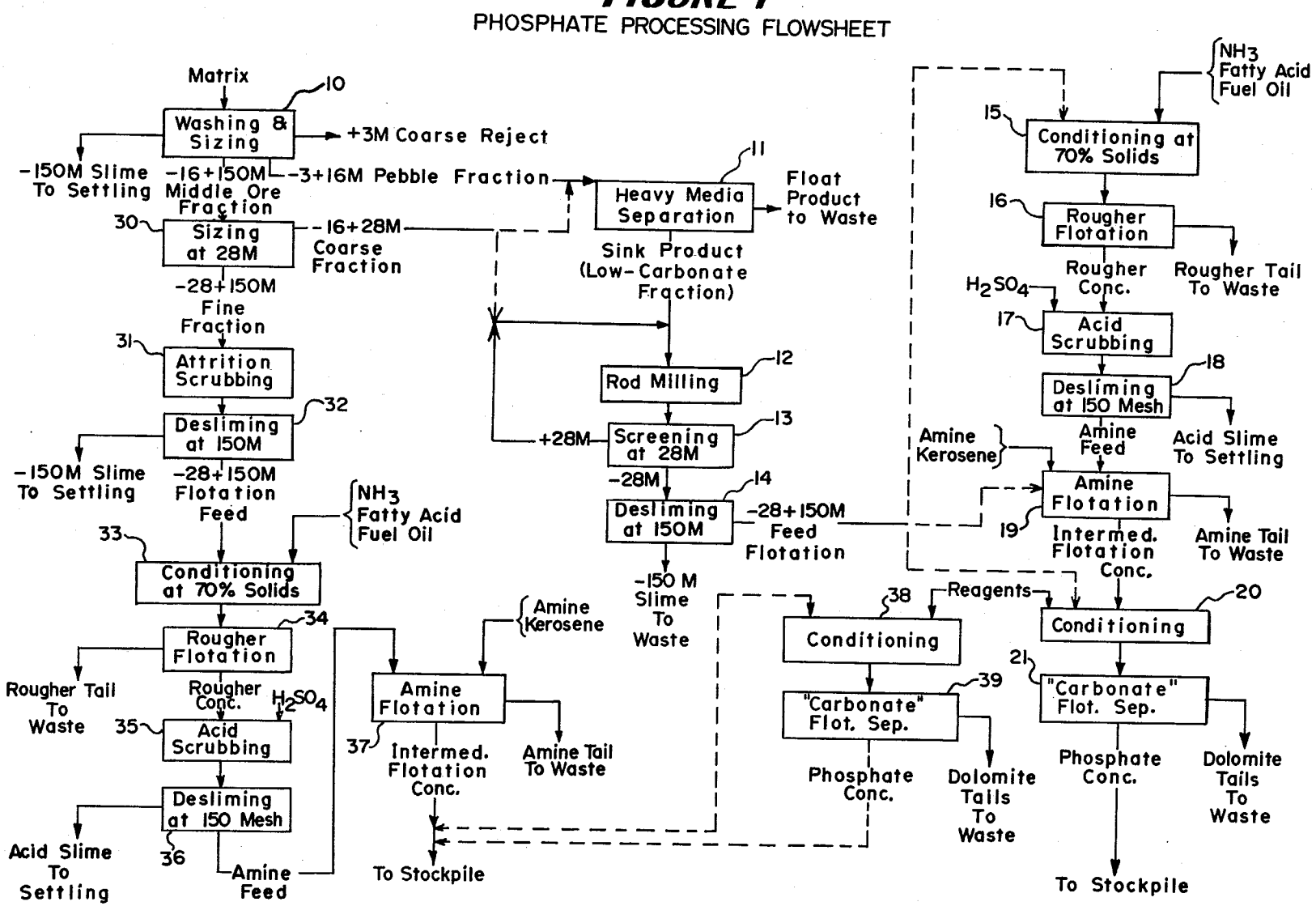

Phosphate ores containing alkaline earth metal carbonate mineral impurities are mined from the earth by conventional methods. The ore matrix usually contains considerable amounts of clay slimes having a particle size of less than about 325 mesh. Although such clay slimes contain phosphate values, their relatively large consumption of reagents in wet beneficiation processes makes their beneficiation currently unfeasible. Thus, the ore matrix is deslimed using techniques well known in the wet mineral processing art.

As used herein, the term "mesh" refers to standard Tyler mesh, and if an ore fraction is said to have a particle size smaller than a certain mesh, such statement means that substantially all of the fraction will pass through a screen having that Tyler mesh size, and likewise, if an ore fraction is said to have a particle size greater than a certain mesh, then substantially none of the material will pass through a screen having that Tyler mesh size.

In addition to clay slimes, the carbonate-phosphate ore matrix also usually contains large rocks or agglomerates (so-called mud balls) which must be either reduced in size or separated from the matrix. Accordingly, after the matrix has been transported to the beneficiation plant, it is subjected to conventional washing and sizing. Such washing and sizing is connected in vibrating screens, log washers, rotating trommels and the like as is well known in the art. If large particles are to be reduced in size, the matrix may be ground in suitable grinding equipment such as hammermills, impactors, or the like. The matrix is advantageously sized at about 2 mesh to about 5 mesh, preferably about 3 mesh. The oversize material is generally discarded. The sized material is then usually deslimed, reuslting in a deslimed ore matrix having a particle size smaller than about 2.5 mesh and larger than about 325 mesh, and preferably larger than about 150 mesh.

The deslimed ore matrix is split at about 12 mesh to about 20 mesh, preferably about 16 mesh, to form a pebble fraction having a particle size larger than about 12 mesh to about 20 mesh and a middle ore fraction having a particle size smaller than about 12 mesh to about 20 mesh. The pebble fraction has generally been found to contain discreet particles of alkaline earth metal carbonate mineral impurities. In addition to such impurities, the pebble fraction contains particles of apatite which may be relatively pure or which may contain locked siliceous gangue and alkaline earth metal carbonate mineral impurities. Discreet particles of siliceous gangue may also be present in this fraction.

It has been found that the concentration of alkaline earth metal carbonate mineral impurity in the pebble fraction can be reduced by subjecting that fraction to a gravity separation. Although reported density values ranges for alkaline earth metal carbonate minerals, such as dolomite and calcite, are very close to, and even overlap, those reported for apatite, because of porosity differences, the apparent densities for these minerals have been found to be substantially lower than the reported values and are sufficiently different to allow a gravity separation.

The preferred type of gravity separation employed in the method of this invention is a heavy media separation, although other types of separation, such as jigging, are not precluded. The theory of heavy media separation is that a feed matieral comprising a valuable mineral and a gangue mineral which have different densities is placed in a medium having an effective specific gravity between that of the valuable mineral and that of the gangue. The less dense substance, therefore, floats to the surface and the more dense substance sinks.

Heavy media separations may be conducted in several types of equipment using a variety of heavy media. The simplest types of equipment are drum washers or cone vessels which are merely containers for the heavy medium. Other types of equipment include hydrocyclones, such as the Dynawhirlpool(R) Separator (manufactured by Minerals Separation Corporation, New York, N. Y., and utilize heavy media in circular motion. Thus, centrifugal force contributes to the separation. Such separators involve a conical or cylindrical vessel into which the heavy medium is forced tangentially. A swirling motion is established and a vortex is formed. The feed material is introduced into the vessel, the sink product is removed at the outer periphery of the vessel, and the float product is removed at the vortex. These types of separators are generally preferred because they are more efficient and they readily allow for a continuous process.

Various heavy media may be employed in the separation, such as heavy liquids, e.g. aqueous solutions such as barium iodide solution, or thallous formate-malonate solution, or organic liquids, such as acetylene tetrabromide, methylene iodide and the like. Other heavy media include aqueous suspensions of solids such as magnetite, ferrosilicon, barite plus clay, or galena. The specific gravity of such suspensions can be adjusted by varying the concentration of the solid. Preferred heavy media for the method of this invention are aqueous suspensions of solids, most preferably of magnetite or ferrosilicon. Such media are advantageous, because the solid particles of the heavy medium can be recovered from the beneficiated ore products using magnetic separators.

The specific gravity of the heavy medium is adjusted to effect a separation of a substantial portion of the alkaline earth metal carbonate mineral impurity from the apatite. The specific garvity will vary with the particular impurities being removed. For dolomitic phosphate ores, specific gravities in the range of from about 1.8 to 2.5 are usually employed. Preferred specific gravities for cone type separators range from about 1.8 to about 2.0 and for hydrocyclones, such as the dynawhirlpool separator, range from about 2.2 to about 2.4.

A substantial portion of the alkaline earth metal carbonate mineral impurity reports to the float product of the heavy media separation. A low-carbonate fraction, which remains in the sink product, is comminuted and screened at a particle size satisfactory for flotation, e.g. from about 24 to 35 mesh, preferably about 28 to 32 mesh. Comminution generally causes the formation or liberation of very fine particles or slimes, so the ore is advantageously deslimed prior to further beneficiation. The comminuted, deslimed fraction forms the flotation feed.

The gravity separation has been found to significantly reduce the content of alkaline earth metal carbonate mineral impurities in the phosphate ore. Such product, however, often still contains an objectionable concentration of such impurity and also usually contains siliceous gangue. If the concentration of the siliceous gangue is objectionably high in the low-carbonate fraction from the gravity separation, then means should be employed for substantially removing such gangue. The conventional "double float" flotation as described by Crago in U.S. Pat. No. 2,293,640, incorporated herein by reference, is advantageously employed for such purpose. The concentration of siliceous gangue is advantageously reduced to less than about 10 weight % or preferably less than 5 weight % for South Florida ores. If the concentration of the siliceous gangue is only moderately high, e.g. about 13 weight % or less, then a conventional amine flotation, that is, the second step of the Crago process, is generally satisfactory to reduce the siliceous gangue to a satisfactory level. The concentrate from the siliceous gangue-removing means provides a low-silica flotation feed for a carbonate reduction flotation.

The low-silica product from the amine flotation or the "double float" flotation, or if sufficiently low in siliceous gangue, from the low-carbonate fraction from the gravity separation, is subjected to a flotation to substantially remove alkaline earth metal carbonate mineral impurities. A particularly advantageous method is the flotation method described by Snow, R. E. in copending U.S. patent application Ser. No. 788,070 incorporated herein by reference (sometimes herein called the "carbonate" flotation). That method comprises conditioning a phosphate ore concentrate at an apatite-reagentizing pH in an aqueous conditioning slurry having a solids content content of from about 55 weight % to about 75 weight % and containing an apatite-collecting cationic reagent in an amount of from 0.2 to about 5.0 lb per ton (about 0.1 to about 2.5 g per kg) of phosphate ore at a concentration of from about 0.04 to about 7.0 g per liter of water in the conditioning slurry, and containing a cationic reagent-extending amount of a normally liquid hydrocarbon, thereby forming a reagentized phosphate ore; and subjecting the reagentized phosphate ore to a froth flotation, wherein a substantially greater amount of the apatite from the phosphate ore is recovered in the froth concentrate and a substantially greater amount of the alkaline earth metal carbonate mineral impurity is rejected in the underflow tailings. The method is very effective for reducing the concentraton of the alkaline earth metal carbonate mineral impurity in the ore to an acceptable level.

The middle ore fraction from the washing and sizing operation, having a particle size smaller than about 12 mesh to about 20 mesh, is also beneficiated to a high BPL, low-carbonate material. That fraction is first split at about 20–32 mesh, preferably about 24–28 mesh to form a coarse fraction having a particle size greater than about 24–28 mesh and a fine fraction having a particle size smaller than about 24–28 mesh. The coarse fraction, which often contains relatively high concentrations of silica, may be treated in two ways, depending upon the concentration of alkaline earth metal carbonate mineral impurity in that fraction. If the fraction contains a high concentration of such carbonate mineral impurity in discreet particles, e.g. if the concentration of such carbonate mineral is substantially equal to or greater than that of the pebble fraction, then the fraction is advantageously combined with the pebble fraction and subjected to a gravity separation. On the other hand, if the fraction contains a low concentration of such carbonate impurity, that is substantially lower than that of the pebble fraction, e.g. about 75% or less than that of the pebble fraction; or if such impurity is locked in the apatite, then the fraction is advantageously combined with the sink product from gravity separation.

The fine fraction is beneficiated just as the comminuted sink product from the gravity separation, except that prior to flotation, the material is advantageously subjected to a so-called attrition scrubbing. By attrition scrubbing is meant agitation of a high solids pulp of the material so that there is significant contact between the particles. The pulp advantageously contains from about 65% to 75% by weight solids. It has been found that some of the alkaline earth metal carbonate mineral impurity in this fraction occurs on the surface of the ore particles. Attrition scrubbing is effective to separate a substantial portion of these impurities which are subsequently removed by desliming. The deslimed, scrubbed fraction may be further beneficiated by flotation to recover the apatite values in good yield and purity. The fraction is first advantageously subjected to the "double float" flotation to reduce the siliceous gangue. In some cases, the fine fraction will not require further beneficiation; however, if the "double float" concentrate contains an objectionable quantity of alkaline earth metal carbonate mineral impurity, then such impurity is advantageously removed by a flotation method as previously described.

The invention is further illustrated by the drawings, wherein FIG. 1 is a flow diagram of a preferred embodiment of the present invention. The invention is not limited to the preferred embodiment, but is encompassed by the broad scope of the appended claims.

The matrix as mined from the earth is transported to the beneficiation plant by conventional means and is subjected to a washing and sizing operation 10. This step removes the −150 mesh slimes and the +3 mesh coarse product. The −3 +150 mesh product is split at 16 mesh forming a −3 +16 mesh pebble fraction and a −16 +150 mesh middle ore fraction. The pebble fraction undergoes a gravity separation 11 yielding a low-carbonate sink product which is comminuted 12 and sized 13 at 28 mesh. The −28 mesh material is deslimed 14 to form a −28 +150 mesh flotation feed. This flotation feed may be treated in any of three ways, depending upon the concentration of siliceous gangue therein. If the flotation feed does not contain an objectionable amount of siliceous gangue, e.g. less than about 10 weight % or preferably less than 5 weight %, it can be subjected to the "carbonate" flotation, 20 and 21, directly as indicated by the dotted line in the drawing. More often, however, the concentration of the siliceous gangue is such that a siliceous gangue-removing means must be employed. If the concentration of siliceous gangue is less than about 13 weight %, a conventional amine flotation 19 may be employed to reduce that gangue to a satisfactory level. If the concentration of such gangue is substantially greater than about 13 weight %, then the flotation feed is first subjected to a conventional "double float" flotation. To do so, the flotation feed is conditioned with fatty acid reagents 15 and the apatite is floated 16. The reagent is removed from the rougher flotation concentrate by acid scrubbing 17. The conditioning, flotation and scrubbing steps often generate slimes, therefore, the scrubbed material is deslimed 18, thereby forming a feed for an amine flotation. In the amine flotation 19, substantially all of the remaining siliceous gangue is floated, leaving a low-silica intermediate flotation concentrate.

The low-silica intermediate flotation concentrate is subjected to the "carbonate" flotation method of Snow, R. E., previously cited, for removing the alkaline earth metal carbonate mineral impurity. The low-silica intermediate flotation concentrate is conditioned with a cationic reagent and a liquid hydrocarbon 20, then the apatite is separated from the alkaline earth metal carbonate mineral impurity by flotation 21, yielding a phosphate concentrate having a high BPL content and a low concentration of siliceous and carbonate gangue.

The −16 +150 mesh middle ore fraction from the washing and sizing operation 10 is split at 28 mesh 30. As indicated by the dotted line, the −16 +28 mesh coarse fraction may be combined with the pebble fraction and subjected to the gravity separation 11, or it may be combined with the sink product from the gravity separation, depending upon the content of alkaline earth metal carbonate mineral impurity.

The −28 +150 mesh fine fraction is subjected to attrition scrubbing 31 and desliming 32 to form a low-carbonate fine fraction. That fraction is treated like the comminuted feed from the gravity separation, however, it usually contains substantial amounts of siliceous gangue thus requiring the "double float" flotation, 33–37. The concentrate from the amine flotation 37 often contains satisfactorily low concentrations of alkaline earth metal carbonate mineral impurity that it does not require further beneficiation. The carbonate flotation steps, 38 and 39, are optional, therefore, as indicated by the dotted lines, depending upon the concentration of carbonate impurity in the amine concentrate.

It is thus apparent that a method is disclosed for beneficiating a phosphate ore matrix containing an alkaline earth metal carbonate impurity to obtain a high BPL phosphate concentrate which is substantially free of undesirable gangue minerals. The invention is further illustrated by the following examples which are not intended to be limited.

EXAMPLE 1

A phosphate ore matrix mined from a South Florida ore deposit was beneficiated by the method of the present invention. The matrix was first processed in a conventional washer using trommels, log washers and screens. The −150 mesh and +3 mesh materials were discarded as waste product. The −3 +150 mesh is split at 16 mesh, and the −3 +16 mesh fraction was subjected to a heavy media separation in a cone type separator. The heavy medium was ferrosilicon suspended in water and had a specific gravity of about 1.85. Ferrosilicon was recovered from the ore fractions by a magnetic separation. The float product from the heavy medium separation was discarded. The −16 +150 mesh material from the washing step was screened at 28 mesh. The sink product from the heavy medium separation was combined with the −16 +28 mesh fraction, and the mixture was comminuted using a rod mill and screened to −28 mesh. The −28 mesh fraction was deslimed yielding a −28 +150 mesh flotation feed. The −28 mesh fraction was conditioned at about 70% solids with Acintol FA-1 and fuel oil while the pH was controlled to about 9.3 with ammonia.

The conditioned feed was subjected to a rougher flotation wherein the reagentized apatite was floated away from a substantial portion of the silica. The concentrate from the rougher flotation was then scrubbed with sulfuric acid to remove the reagents and was deslimed, thereby forming an amine flotation feed. The amine flotation feed was then floated with a mixture of aliphatic amine condensate (Custamine 3010) and kerosene. The phosphate concentrate recovered from the amine flotation underflow was the feed for the carbonate flotation. The feed was conditioned with a higher aliphatic amine acetate (Armac T) and kerosene at a pH of about 5.8. The pH was adjusted with hydrofluoric acid. The reagentized feed was then subjected to a "carbonate" separation wherein the apatite was floated away from the alkaline earth metal carbonate mineral impurities using a rougher-cleaner-recleaner circuit.

The −28 +150 mesh fraction from the first screening was attrition scrubbed at 70% solids, and, after scrubbing, the material was deslimed at 150 mesh. The deslimed material was then subjected to a "double float" flotation. It was found that the concentrate from the double float flotation was sufficiently low in dolomite that a "carbonate" flotation was not required.

The material balance shown in Table I indicates the yields and product distributions obtained at various stages of the process. Numbers in parentheses are calculated rather than actual analyses. "% BPL" stands for percent phosphate calculated as bone phosphate of lime. The concentration of MgO and CaO indicate the amount of dolomite and calcite in a fraction. The insolubles are primarily siliceous gangue. The reference numerals in the table refer to the flow diagram shown in FIG. 1 of the drawings. The numerals represent the step of the process from which the ore fraction was obtained. N.A. indicates not analyzed.

TABLE I

PROCESSING MATERIAL BALANCE

| | | | | | | | % Distribution | | |
|---|---|---|---|---|---|---|---|---|---|
| % Wt. | Ref. | Fraction | % BPL | % Insol | % MgO | % CaO | BPL | Insol | MgO |
| 1.0 | 10 | +3M Reject | 12.25 | 14.75 | 14.00 | 30.15 | 0.6 | 0.3 | 3.5 |
| 4.4 | 10 | 3/16M Pebble | 45.18 | 14.09 | 5.08 | N.A. | 10.2 | 1.2 | 5.5 |
| 4.4 | 30 | 16/28M Feed | 40.26 | 37.09 | 1.14 | N.A. | 9.1 | 3.2 | 1.3 |
| 58.2 | 30 | 28/150M Feed | 22.65 | 66.33 | 0.36 | N.A. | 67.6 | 75.9 | 5.3 |
| 32.0 | 10 | −150M Slimes | 7.58 | 30.77 | 10.50 | 21.43 | 12.5 | 19.4 | 84.4 |
| 100.0 | — | Comp. Matrix | (19.49) | (50.85) | (3.98) | (N.A.) | 100.0 | 100.0 | 100.0 |
| Fine Feed Flotation: | | | | | | | | | |
| 17.7 | 37 | 28/150M Conc | 68.88 | 3.86 | 0.83 | 47.46 | 62.6 | 1.3 | 3.8 |
| 4.2 | 37 | 28/150M Amine Tail | 7.16 | N.A. | N.A. | N.A. | 1.5 | — | — |
| 35.6 | 34 | 28/150M Rougher Tail | 1.20 | N.A. | N.A. | N.A. | 2.2 | — | — |
| 0.6 | 32 | 28/150M Slime 1 | 39.97 | N.A. | 6.40 | N.A. | 1.2 | — | 1.0 |
| 0.1 | 36 | 28/150M Slime 2 | 24.57 | N.A. | 9.30 | N.A. | 0.1 | — | 0.3 |
| 58.2 | — | Comp 28/150M Feed | (22.65) | (66.33) | (0.36) | N.A. | 67.6 | 75.8 | 5.3 |
| H.M. Separation: | | | | | | | | | |
| 1.14 | 11 | 3/16M Float @1.85 | 18.33 | 12.59 | 13.10 | N.A. | 1.1 | 0.3 | 3.8 |
| 3.26 | 11 | 3/16M Sink @1.85 | 54.56 | 14.70 | 2.28 | N.A. | 9.1 | 0.9 | 1.7 |
| 4.40 | — | Comp. Pebble | (45.18) | (14.09) | (5.08) | N.A. | 10.2 | 1.2 | 5.5 |
| Grinding & Desliming: | | | | | | | | | |
| 5.81 | 14 | 28/150M Feed | 45.68 | 31.09 | 1.04 | N.A. | 13.6 | 3.5 | 1.5 |

TABLE I-continued

PROCESSING MATERIAL BALANCE

| % Wt. | Ref. | Fraction | % BPL | % Insol | % MgO | % CaO | % Distribution BPL | Insol | MgO |
|---|---|---|---|---|---|---|---|---|---|
| 1.85 | 14 | −150M Slime | 48.93 | 15.72 | 3.50 | N.A. | 4.6 | 0.6 | 1.5 |
| 7.66 | — | Composite | (46.47) | (27.37) | (1.64) | N.A. | 18.2 | 4.1 | 3.0 |
| Conventional Double Float: | | | | | | | | | |
| 3.77 | 19 | Amine Conc. | (64.23) | (2.30) | (1.54) | N.A. | 12.4 | 0.2 | 1.4 |
| 0.56 | 19 | Amine Tail | 30.21 | N.A. | N.A. | N.A. | 0.9 | — | — |
| 1.48 | 16 | Rougher Tail | 4.35 | N.A. | N.A. | N.A. | 0.3 | — | — |
| 5.81 | — | Composite | (45.68) | (31.09) | (1.04) | N.A. | 13.6 | 3.5 | 1.5 |
| Phosphate-Dolomite Flotation: | | | | | | | | | |
| 3.47 | 21 | Phosphate Conc. | 66.47 | 2.22 | 0.98 | N.A. | 11.8 | 0.1 | 0.8 |
| 0.30 | 21 | Dolomite Tail | 38.50 | (3.67) | (8.00) | N.A. | 0.6 | 0.1 | 0.6 |
| 3.77 | — | Composite | 64.23 | 2.30 | 1.54 | N.A. | 12.4 | 0.2 | 1.4 |
| Total Recovered Conc: | | | | | | | | | |
| 17.7 | 37 | Directly Floated | 68.88 | 3.86 | 0.83 | 47.46 | 62.6 | 1.3 | 3.8 |
| 3.47 | 21 | From HM & Grind | 66.47 | 2.22 | 0.98 | N.A. | 11.8 | 0.1 | 0.8 |
| 21.17 | — | Composite | (68.49) | (3.59) | (0.85) | N.A. | 74.4 | 1.4 | 4.6 |

(85.0 from deslimed matrix)

EXAMPLE 2

The experiment of Example 1 was repeated in all essential details except an ore matrix taken from a different ore body was used. The ore which was processed contained an appreciable quantity of seashell impurity. Table II indicates yields and product distributions for the process steps. The $CaO/P_2O_5$ ratio is given to illustrate the rejection of seashells (calcite) as well as dolomite. The amine concentrate from the −28 +150 mesh middle ore fraction, which was subjected to attrition scrubbing and desliming, was sufficiently low in dolomite and calcite that a carbonate flotation was not required. The combined −16 +28 mesh ore fraction from screening and the −3 +16 mesh heavy media sink product was rodmilled to −28 mesh and deslimed at 150 mesh. This material was subjected to conventional amine flotation using Custamine 3010 plus kerosene to reject siliceous impurities into the froth tailing. The resulting amine concentrate was then subjected to a "carbonate" separation as described in Example 1 for alkaline earth carbonate mineral rejection.

TABLE II

PROCESSING MATERIAL BALANCE

| % Wt. | Ref. | Fraction | % BPL | % Insol | % MgO | % CaO | $CaO/P_2O_5$ | % BPL Distribution |
|---|---|---|---|---|---|---|---|---|
| 3.94 | 10 | +3M Reject | 12.72 | 22.85 | 8.93 | 31.88 | 5.48 | 2.5 |
| 7.52 | 10 | 3/16M Pebble | (39.89) | (13.70) | (4.39) | (43.35) | 2.37 | 15.0 |
| 5.81 | 30 | 16/28M Feed | (49.48) | 19.69 | (1.33) | (38.49) | 1.70 | 14.3 |
| 68.29 | 30 | 28/150M Feed | 19.73 | 67.96 | 0.36 | 14.87 | 1.65 | 67.1 |
| 14.44 | 10 | −150M Slimes | 1.57 | 9.17 | 14.90 | 32.28 | 44.73 | 1.1 |
| 100.00 | — | Comp. Matrix | (20.07) | (50.80) | (3.15) | (21.57) | 2.35 | 100.0 |
| Fine Feed Flotation: | | | | | | | | |
| 19.67 | 37 | 28/150M Conc. | 66.18 | 2.45 | 0.87 | 46.92 | 1.55 | 64.9 |
| 10.34 | 37 | 28/150M Amine Tail | 1.58 | 95.45 | 0.0 | 2.40 | 3.32 | 0.8 |
| 37.70 | 34 | 28/150M Rougher Tail | 0.48 | 95.65 | 0.0 | 1.20 | 5.46 | 0.9 |
| 0.68 | 32 | 28/150M Slime | 16.77 | 13.00 | 10.50 | 33.54 | 4.37 | 0.5 |
| 68.29 | — | Comp. 28/150M Feed | (19.73) | (67.96) | (0.36) | (14.87) | 1.65 | 67.1 |
| HM Separation: | | | | | | | | |
| 2.12 | 11 | 3/16M Float @1.85 | 14.35 | 24.47 | 9.58 | 30.30 | 4.65 | 1.5 |
| 5.40 | 11 | 3/16M Sink @1.85 | 50.05 | 9.46 | 2.49 | 48.52 | 2.12 | 13.5 |
| 7.52 | — | Comp. Pebble | (39.89) | (13.70) | (4.39) | (43.35) | 2.37 | 15.0 |
| Grinding & Desliming: | | | | | | | | |
| 8.87 | 14 | 28/150M Feed | 51.29 | 16.38 | 1.37 | 43.96 | 1.87 | 22.7 |
| 2.34 | 14 | −150M Slime | 43.86 | 8.60 | 3.60 | 41.07 | 2.05 | 5.1 |
| 11.21 | — | Composite | (49.73) | (14.75) | (1.85) | (39.41) | 1.73 | 27.8 |
| Conventional Amine Float: | | | | | | | | |
| 7.63 | 19 | Amine Conc. | 59.03 | 4.17 | 1.58 | 44.89 | 1.66 | 22.5 |
| 1.24 | 19 | Amine Tail | 3.59 | 91.50 | 0.13 | (N.A.) | — | 0.2 |
| 8.87 | — | Composite | (51.29) | (16.38) | (1.39) | (43.96) | 1.87 | 22.7 |
| Phosphate-Dolomite Flotation Separation: | | | | | | | | |
| 6.89 | 21 | Phosphate Conc. | 61.74 | 4.25 | 1.21 | 45.10 | 1.60 | 21.2 |
| 0.74 | 21 | Dolomite Tail | 33.85 | 3.44 | 5.10 | 42.89 | 2.77 | 1.3 |
| 7.63 | — | Composite | (59.03) | (4.17) | (1.58) | (44.89) | 1.66 | 22.5 |
| Total Recovered Conc: | | | | | | | | |
| 19.67 | 37 | Directly Floated | 66.18 | 2.45 | 0.87 | 46.92 | 1.55 | 64.9 |
| 6.89 | 21 | From HM & Grind | 61.74 | 4.25 | 1.21 | 45.10 | 1.60 | 21.2 |
| 26.56 | — | Composite | (65.02) | (2.91) | (0.95) | (46.46) | 1.56 | 86.1 |

(From deslimed matrix = 87.0)

EXAMPLE 3

The experiment of Example 1 was repeated in all essential details except a lower grade ore matrix sample was processed. Table III indicates yields and product distributions for the process steps. The amine concentrate from the −28 +150 mesh middle ore fraction which was subjected to attrition scrubbing was also subjected to a carbonate flotation to further reduce the dolomite concentration. In this example, the −3 +16 mesh heavy media sink product and the −16 +28 mesh ore fraction were separately rodmilled, deslimed, and subjected to flotation separation.

TABLE III

PROCESSING MATERIAL BALANCE

| % Wt. | Ref. | Product | % BPL | % Insol | % MgO | % Distribution BPL | Insol | MgO |
|---|---|---|---|---|---|---|---|---|
| 2.0 | 10 | +3M Reject | 5.58 | (27.50) | 13.90 | 0.8 | 1.2 | 3.8 |
| 13.6 | 10 | 3/16M Pebble | 22.07 | 13.20 | 11.36 | 21.3 | 4.0 | 21.2 |
| 5.7 | 30 | 16/28M Feed | 37.82 | 25.32 | 4.32 | 15.3 | 3.2 | 3.4 |
| 52.3 | 30 | 28/150M Feed | 14.10 | 67.98 | 2.11 | 52.3 | 78.3 | 15.1 |
| 26.4 | 10 | −150M Slimes | 5.54 | 22.90 | 15.60 | 10.3 | 13.3 | 56.5 |
| 100.0 | — | Comp. Matrix | (14.10) | (45.39) | (7.29) | 100.0 | 100.0 | 100.0 |
| Fine Feed Flotation: | | | | | | | | |
| 8.70 | 37 | 28/150M Conc | 68.20 | 2.93 | 0.84 | 42.2 | 0.6 | 1.0 |
| 2.07 | 39 | 28/150M Carbonate Tail | 28.04 | 4.14 | 11.70 | 4.1 | 0.2 | 3.3 |
| 1.94 | 37 | 28/150M Amine Tail | 4.65 | 90.46 | 0.39 | 0.6 | 3.8 | 0.1 |
| 33.52 | 34 | 28/150 Rougher Tail | 1.24 | 94.04 | 0.19 | 2.9 | 69.4 | 0.9 |
| 6.07 | 32 | 28/150M Slime | 5.84 | 32.10 | 11.90 | 2.5 | 4.3 | 9.8 |
| 52.30 | — | Comp. 28/150M Feed | 14.10 | 67.98 | 2.11 | 52.3 | 78.3 | 15.1 |
| HM Separation: | | | | | | | | |
| 3.50 | 11 | 3/16M Float @1.85 | 7.15 | 15.39 | 15.60 | 1.8 | 1.2 | 7.6 |
| 10.10 | 11 | 3/16M Sink @1.85 | 27.23 | 12.44 | 9.89 | 19.5 | 2.8 | 13.6 |
| 13.60 | — | Comp. Pebble | 22.07 | 13.20 | 11.36 | 21.3 | 4.0 | 21.2 |
| Grinding & Desliming Pebble: | | | | | | | | |
| 6.05 | 14 | 28/150M Feed | 34.16 | 15.98 | 7.08 | 14.7 | 2.1 | 5.9 |
| 4.05 | 14 | −150M Slime | 16.89 | 7.15 | 14.10 | 4.8 | 0.7 | 7.7 |
| 10.10 | — | Composite | 27.23 | 12.44 | 9.89 | 19.5 | 2.8 | 13.6 |
| Silica & Dolomite Flotations: | | | | | | | | |
| 2.67 | 21 | Phosphate Conc | 63.71 | 3.50 | 1.07 | 12.1 | 0.2 | 0.4 |
| 2.48 | 21 | Dolomite Tail | 12.77 | 3.81 | 15.99 | 2.3 | 0.2 | 5.4 |
| 0.90 | 19 | Silica Tail | 5.54 | 86.68 | 0.35 | 0.3 | 1.7 | 0.1 |
| 6.05 | — | Composite | 34.16 | 15.98 | 7.08 | 14.7 | 2.1 | 5.9 |
| Grinding & Desliming Coarse Feed: | | | | | | | | |
| 4.79 | 14 | 28/150M Feed | 41.52 | 28.15 | 2.77 | 14.1 | 3.0 | 1.8 |
| 0.91 | 14 | −150M Slime | 18.40 | 10.45 | 12.41 | 1.2 | 0.2 | 1.6 |
| 5.70 | — | Composite | 37.82 | 25.32 | 4.32 | 15.3 | 3.2 | 3.4 |
| Silica & Dolomite Flotation: | | | | | | | | |
| 2.78 | 21 | Phosphate Conc. | 65.55 | 4.81 | 0.99 | 12.9 | 0.3 | 0.4 |
| 0.63 | 21 | Dolomite Tail | 12.44 | 4.85 | 15.35 | 0.6 | 0.1 | 1.3 |
| 1.38 | 19 | Silica Tail | 6.25 | 86.16 | 0.64 | 0.6 | 2.6 | 0.1 |
| 4.79 | — | Composite | 41.52 | 28.15 | 2.77 | 14.1 | 3.0 | 1.8 |
| Total Recovered Conc: | | | | | | | | |
| 8.70 | 37 | Directly Floated | 68.20 | 2.93 | 0.84 | 42.2 | 0.6 | 1.0 |
| 2.78 | 21 | From Coarse Feed | 65.55 | 4.81 | 0.99 | 12.9 | 0.3 | 0.4 |
| 2.67 | 21 | From Pebble | 63.71 | 3.50 | 1.07 | 12.1 | 0.2 | 0.4 |
| 14.15 | — | Composite | (66.78) | (3.32) | (0.91) | 67.2 | 1.1 | 1.8 |
| | | | | | | (76.7 from deslimed matrix) | | |

EXAMPLE 4

A phosphate ore matrix mined from another South Florida ore deposit was processed using the method of the present invention. A multi-ton matrix sample was initially processed in a conventional washer using trommels, log-washers, and screens. The −150 mesh and +3 mesh materials were discarded as waste products. More than 15 tons of the −3 +28 mesh material were subjected to continuous heavy media separation using a Dynawhirlpool(R) hydrocyclone type separator. The heavy medium was magnetite suspended in water to yield a slurry specific gravity of 2.29. Magnetite media was recovered from the ore fractions by magnetic separation. The float product from heavy medium separation was discarded. The sink fraction was processed by rod-milling to −28 mesh, desliming, and multiple-stage flotation as described in Example 2. The original −28 +150 mesh middle ore fraction was subjected to conventional double flotation plus carbonate flotation to further reduce the dolomite concentration. Table IV presents yields and product distributions for the process steps.

TABLE IV

PROCESSING MATERIAL BALANCE

| % Wt. | Ref. | Product | % BPL | % Insol | % MgO | % Distribution BPL | Insol | MgO |
|---|---|---|---|---|---|---|---|---|
| 2.0 | 10 | +3M Reject | 6.94 | 20.00 | 14.10 | 0.8 | 1.0 | 4.1 |
| 13.4 | 10 | 3/16M Pebble | (36.59) | (18.85) | (5.35) | 47.8 | 10.0 | 17.0 |
| 8.3 | 30 | 16/28M Feed | | | | | | |
| 45.8 | 30 | 28/150M Feed | 17.53 | 67.45 | 1.39 | 48.3 | 75.5 | 9.3 |
| 30.5 | 10 | −150M Slimes | 1.68 | 18.20 | 15.60 | 3.1 | 13.5 | 69.6 |
| 100.0 | — | Comp. Matrix | (16.62) | (40.93) | (6.84) | 100.0 | 100.0 | 100.0 |

TABLE IV-continued

PROCESSING MATERIAL BALANCE

| % Wt. | Ref. | Product | % BPL | % Insol | % MgO | % Distribution BPL | Insol | MgO |
|---|---|---|---|---|---|---|---|---|
| Fine Feed Flotation: | | | | | | | | |
| 10.75 | 37 | 28/150M Conc | 65.46 | 5.25 | 0.94 | 42.4 | 1.4 | 1.5 |
| 1.33 | 39 | 28/150M Dolomite Tail | 30.55 | 5.18 | 10.50 | 2.5 | 0.2 | 2.0 |
| 1.84 | 37 | 28/150M Amine Tail | 5.19 | 90.38 | 0.18 | 0.5 | 4.0 | 0.1 |
| 28.40 | 34 | 28/150M Rougher Tail | 1.21 | 95.48 | 0.13 | 2.0 | 66.3 | 0.5 |
| 3.48 | 32 | 28/150M Slime | 4.31 | 42.40 | 10.20 | 0.9 | 3.6 | 5.2 |
| 45.80 | — | 28/150M Feed Comp. | (17.53) | (67.45) | (1.39) | 48.3 | 75.5 | 9.3 |
| H.M. Separation: | | | | | | | | |
| 4.33 | 11 | 3/28M Float at 2.29 | 20.60 | 15.40 | 11.20 | 5.4 | 1.6 | 7.1 |
| 17.37 | 11 | 3/28M Sink at 2.29 | (40.60) | (19.70) | (3.90) | 42.4 | 8.4 | 9.9 |
| 21.70 | — | Composite | (36.59) | (18.85) | (5.35) | 47.8 | 10.0 | 17.0 |
| Grinding & Desliming H.M. Sink: | | | | | | | | |
| 12.05 | 14 | 28/150M Feed | (45.98) | N.A. | N.A. | 33.3 | — | — |
| 5.32 | 14 | −150M Slime | 28.38 | N.A. | N.A. | 9.1 | — | — |
| 17.37 | — | Composite | 40.60 | 19.70 | 3.90 | 42.4 | 8.4 | 9.9 |
| Silica & Dolomite Flotations: | | | | | | | | |
| 7.91 | 21 | Phosphate Conc. | 63.48 | 4.56 | 1.36 | 30.2 | 0.9 | 1.6 |
| 1.66 | 21 | Dolomite Tail | 24.00 | 4.44 | 12.80 | 2.4 | 0.2 | 3.1 |
| 2.48 | 19 | Silica Tail | 4.91 | N.A. | N.A. | 0.7 | — | — |
| 12.05 | — | Composite | (45.98) | N.A. | N.A. | 33.3 | — | — |
| Total Recovered Conc: | | | | | | | | |
| 10.75 | 37 | Directly Floated | 65.46 | 5.25 | 0.94 | 42.4 | 1.4 | 1.5 |
| 7.91 | | From +28M | 63.48 | 4.56 | 1.36 | 30.2 | 0.9 | 3.1 |
| 18.66 | — | Composite | (64.63) | (4.93) | (1.11) | 72.6 | 2.3 | 4.6 |
| | | | | | | (75.4 from deslimed matrix) | | |

We claim:

1. A method for beneficiating a phosphate ore matrix containing apatite, siliceous gangue, and an alkaline earth metal carbonate mineral impurity, comprising the steps of (a) washing and sizing the ore matrix to substantially deslime the matrix and to remove particles larger than from about 2 mesh to about 5 mesh, thereby forming a deslimed ore matrix;

(b) splitting the deslimed ore matrix at about 12 to about 20 mesh to form a pebble fraction having a particle size greater than about 12 to about 20 mesh and a middle ore fraction having a particle size less than about 12 to about 20 mesh;

(c) subjecting the pebble fraction to a gravity separation wherein a portion of the less dense alkaline earth metal carbonate mineral impurity is separated from the apatite, thereby producing a low-carbonate fraction;

(d) splitting the middle ore fraction at about 24 mesh to about 32 mesh to form a coarse fraction having a particle size greater than about 24 mesh to about 32 mesh and a fine fraction having a particle size smaller than about 24 mesh to about 32 mesh;

(e) combining the coarse fraction with the pebble fraction to enter the gravity separation of step (c);

(f) comminuting, sizing and desliming the low-carbonate fraction to a deslimed particle size of less than about 24 to about 32 mesh, thereby forming a flotation feed containing discreet particles of apatite and siliceous gangue;

(g) subjecting the flotation feed to a "double float" flotation, thereby forming a low silica intermediate flotation concentrate; and (h) subjecting the low silica intermediate flotation concentrate to a flotation to remove alkaline earth metal carbonate mineral impurity therefrom and to form a phosphate concentrate.

2. The method of claim 1, further comprising the steps of (i) subjecting the fine fraction from step (d) to attrition scrubbing and desliming to form a carbonate-reduced fine fraction;

(j) subjecting the carbonate-reduced fine fraction to a "double-float" flotation, thereby forming a "double float" concentrate.

3. The method of claim 2 wherein the alkaline earth metal carbonate mineral impurity is dolomite.

4. The method of claim 2 wherein the alkaline earth metal carbonate mineral impurity is calcite.

5. The method of claim 2 wherein the gravity separation is a heavy media separation employing an aqueous suspension of magnetite or ferrosilicon having a specific gravity of from about 1.8 to about 2.5 as the heavy medium, and wherein the flotation to remove alkaline earth metal carbonate mineral impurity from the low-silica intermediate flotation concentrate is a "carbonate" flotation.

6. The method of claim 2 further comprising the step of subjecting the "double float" concentrate of step (J) to a flotation to remove akaline earth metal carbonate mineral impurities therefrom and to form a phosphate concentrate.

7. The method of claim 6 wherein the gravity separation is a heavy media separation employing an aqueous suspension of magnetite or ferrosilicon having a specific gravity of from about 1.8 to about 2.5 as the heavy medium, and wherein the flotations to remove alkaline earth metal carbonate mineral impurity are "carbonate" flotations.

8. The method of claim 1 wherein the alkaline earth metal carbonate mineral impurity is dolomite; the deslimed ore fraction is split at about 16 mesh in step (b); the middle ore fraction is split at about 28 mesh in step (d); and the flotation feed produced in step (f) is comminuted, sized and deslimed to a deslimed particle size of less than about 28 mesh.

9. The method of claim 8 wherein the gravity separation is a heavy media separation employing an aqueous suspension of magnetite or ferrosilicon having a specific gravity of from about 1.8 to about 2.5 as the heavy medium, and the flotation to remove alkaline earth metal carbonate mineral impurity is a "carbonate" flotation.

10. The method of claim 1 wherein the alkaline earth metal carbonate impurity is calcite.

11. The method of claim 1 wherein the gravity separation is a heavy media separation employing an aqueous suspension of magnetite or ferrosilicon having a specific gravity of from about 1.8 to about 2.5 as the heavy medium, and the flotation of step (h) is a "carbonate" flotation.

12. A method for beneficiating a phosphate ore matrix containing apatite, siliceous gangue, and an alkaline earth metal carbonate mineral impurity, comprising the steps of (a) washing and sizing the ore matrix to substantially deslime the matrix and to remove particles larger than from about 2 mesh to about 5 mesh thereby forming a deslimed ore matrix;

(b) splitting the deslimed ore matrix at about 12 to about 20 mesh to form a pebble fraction having a particle size greater than about 12 to about 20 mesh and a middle ore fraction having a particle size less than about 12 to about 20 mesh;

(c) subjecting the pebble fraction to a gravity separation wherein a portion of the less dense alkaline earth metal carbonate mineral impurity is separated from the apatite, thereby producing a low carbonate fraction;

(d) splitting the middle ore fraction at about 24 mesh to about 32 mesh to form a coarse fraction having a particle size greater than about 24 mesh to about 32 mesh and a fine fraction having a particle size smaller than about 24 mesh to about 32 mesh;

(e) combining the coarse fraction with the pebble fraction to enter the gravity separation of step (c);

(f) comminuting, sizing and desliming the low-carbonate fraction to a deslimed particle size of less tha about 24 to about 32 mesh,thereby forming a flotation feed;

(g) subjecting the flotation feed to a flotation to remove alkaline earth metal carbonate impurity therefrom and to form a phosphate concentrate.

13. The method of claim 12 further comprising the steps of subjecting the flotation feed from step (f) to a conventional amine flotation to form an intermediate flotation concentrate, and subjecting the intermediate flotation concentrate to the flotation of step (g).

14. The method of claim 13 wherein the gravity separation is a heavy media separation employing an aqueous suspension of magnetite or ferrosilicon having a specific gravity of from about 1.8 to about 2.5 as the heavy medium, and the flotation to remove alkaline earth metal carbonate mineral impurity is a "carbonate" flotation.

15. The method of claim 12 wherein the gravity separation is a heavy media separation employing an aqueous suspension of magnetite or ferrosilicon having a specific gravity of from about 1.8 to about 2.5 as the heavy medium, and the flotation of step (g) is a "carbonate" flotation.

16. A method for beneficiating a phosphate ore matrix containing apatite, siliceous gangue, and an alkaline earth metal carbonate mineral impurity, comprising the steps of (a) washing and sizing the ore matrix to substantially deslime the matrix and to remove particles larger than from about 2 mesh to about 5 mesh, thereby forming a deslimed ore matrix;

(b) splitting the deslimed ore matrix at about 12 to about 20 mesh to form a pebble fraction having a particle size greater than about 12 to about 20 mesh and a middle ore fraction having a particle size less than about 12 to about 20 mesh;

(c) subjecting the pebble fraction to a gravity separation wherein a portion of the less dense alkaline earth metal carbonate mineral impurity is separated from the apatite, thereby producing a low-carbonate fraction;

(d) splitting the middle ore fraction at about 24 mesh to about 32 mesh to form a coarse fraction having a particle size greater than about 24 mesh to about 32 mesh and a fine fraction having a particle size smaller than about 24 mesh to about 32 mesh;

(e) combining the coarse fraction with the low-carbonate fraction from the gravity separation of step (c);

(f) comminuting, sizing and desliming the low-carbonate fraction to a deslimed particle size of less than about 24 to about 32 mesh, thereby forming a flotation feed;

(g) subjecting the flotation feed to a flotation to remove alkaline earth metal carbonate mineral impurity and to form a phosphate concentrate.

17. The method of claim 16 furthercomprising the steps of subjecting the flotation feed from step (f) to a conventional amine flotation to form an intermediate flotation concentrate, and subjecting the intermediate flotation concentrate to the flotation of step (g).

18. The method of claim 17 wherein the gravity separation is a heavy media separation employing an aqueous suspension of magnetite or ferrosilicon having a specific gravity of from about 1.8 to about 2.5 as the heavy medium, and the flotation to remove alkaline earth metal carbonate mineral impurity is a "carbonate" flotation.

19. The method of claim 16 further comprising the steps of subjecting the flotation feed from step (f) to a "double float" flotation to form an intermediate flotation concentrate and subjecting the intermediate flotation concentrate to the flotation of step (g).

20. The method of claim 19 wherein the gravity separation is a heavy media separation employing the aqueous suspension of magnetite or ferrosilicon having a specific gravity of from about 1.8 to about 2.5 as the heavy medium, and the flotation to remove alkaline earth metal carbonate mineral impurity is a "carbonate" flotation.

21. The method of claim 16 wherein the gravity separation is a heavy media separation employing an aqueous suspension of magnetite or ferrosilicon having a specific gravity of from about 1.8 to about 2.5 as the heavy medium, and the flotation of step (g) is a "carbonate" flotation.

* * * * *

UNITED STATES PATENT AND TRADEMARK OFFICE

CERTIFICATE OF CORRECTION

PATENT NO. : 4,189,103

DATED : February 19, 1980

INVENTOR(S) : James E. Lawver; Robert E. Snow; Walter O. McClintock

It is certified that error appears in the above-identified patent and that said Letters Patent are hereby corrected as shown below:

Column 1, line 31, "superhosphate" should read — superphosphate —.

Column 1, line 33, "pentalities" should read — penalties —.

Column 1, line 50, "±325" should read — +325 —.

Column 2, line 59, "floatation" should read — flotation —.

Column 3, line 29, "connected" should read — conducted —.

Column 3, line 37, "reuslting" should read — resulting —.

Column 3, line 57, "values" should read — value —.

Column 4, line 1, "matieral" should read — material —.

Column 4, line 42, "garvity" should read -- gravity --

Column 5, line 27, delete "content" second occurrence

Claim 6, line 48, "J" should read — (j) —.

Claim 6, line 49, "akaline" should read — alkaline —.

Signed and Sealed this

*Tenth* Day of *June 1980*

[SEAL]

*Attest:*

*Attesting Officer*

SIDNEY A. DIAMOND

*Commissioner of Patents and Trademark*